US008118187B2

(12) United States Patent
D'Amato

(10) Patent No.: US 8,118,187 B2
(45) Date of Patent: Feb. 21, 2012

(54) LID FOR A CUP-SHAPED RECEPTACLE

(75) Inventor: Gianfranco D'Amato, Arzano Napoli (IT)

(73) Assignee: Seda S.p.A., Arzano Napoli (IT)

( * ) Notice: Subject to any disclaimer, the term of this patent is extended or adjusted under 35 U.S.C. 154(b) by 738 days.

(21) Appl. No.: 12/093,970

(22) PCT Filed: Nov. 9, 2006

(86) PCT No.: PCT/EP2006/010766

§ 371 (c)(1),
(2), (4) Date: Oct. 7, 2008

(87) PCT Pub. No.: WO2007/057123

PCT Pub. Date: May 24, 2007

(65) Prior Publication Data

US 2009/0159606 A1 Jun. 25, 2009

(30) Foreign Application Priority Data

Nov. 18, 2005 (EP) ..... 05025264

(51) Int. Cl.
*B65D 45/16* (2006.01)

(52) U.S. Cl. ..... 220/324; 220/780; 220/788; 229/404

(58) Field of Classification Search ..... 220/315, 220/703, 298, 781, 786, 297, 784, 788, 709, 220/293; 229/404

See application file for complete search history.

(56) References Cited

U.S. PATENT DOCUMENTS 3,065,875 A 11/1962 Negoro
3,583,596 A 6/1971 Brewer
3,749,277 A 7/1973 Kinney
5,253,781 A 10/1993 Van Melle et al.
5,944,208 A 8/1999 Gale (Continued)

FOREIGN PATENT DOCUMENTS

DE 29906577 7/1999

(Continued)

OTHER PUBLICATIONS

Decision of Rejection from Japanese Patent Office, Japanese Patent Appln. No. 2008-540490, Jun. 28, 2011 (partial English-language translation, 2 pp.).

*Primary Examiner* — Jacob K Ackun
*Assistant Examiner* — Kareen Rush
(74) *Attorney, Agent, or Firm* — Fish & Richardson P.C.

(57) ABSTRACT

The present invention is directed to a lid (5) with a central lid portion (6) and with a peripheral clamping groove (7) formed between an outer groove wall (8) and an inner groove wall (9) for being clamped onto a beaded rim (4) of a cup-shaped receptacle (1). A constriction (10) is provided on at least a peripheral section of the outer groove wall (8), the constriction (10) forming a projection (14) into the interior of the groove (7), this projection (14) comprising a projecting tip (15), an upper wall (16) and a lower wall (17), and the projecting tip (15) defining a horizontal plane (H). The invention is characterized in that an angle (α) between the horizontal plane (H) and a tangential plane (T16)to the end of the upper wall (16) adjacent the projecting tip (15) is smaller than an angle (θ) between the horizontal plane (H) and a tangential plane (T17) to the end of the lower wall (17) adjacent the projecting tip (15).

25 Claims, 8 Drawing Sheets

U.S. PATENT DOCUMENTS

Figure 1:
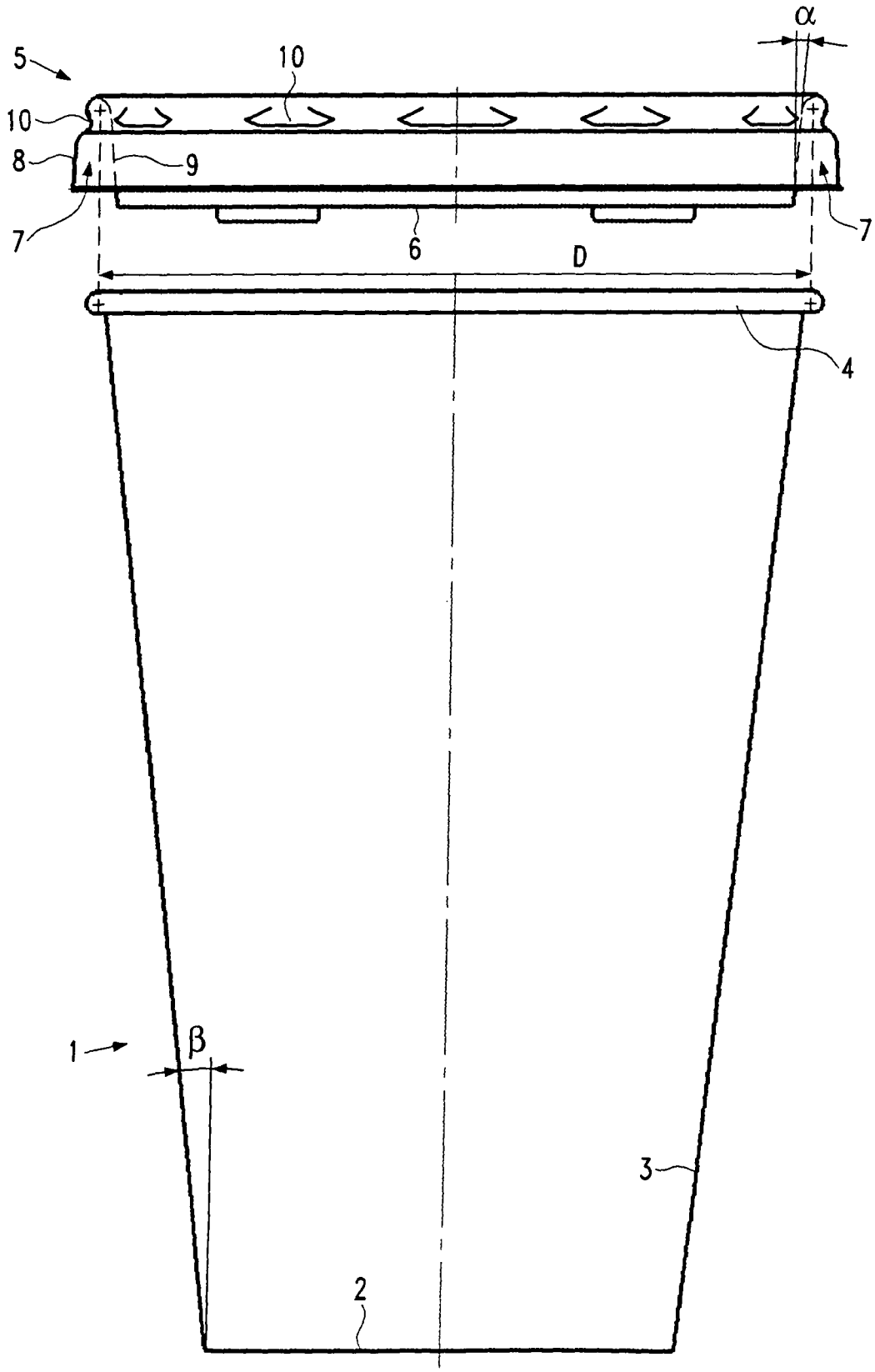

| | | | | |
|---|---|---|---|---|
| 5,975,344 | A | 11/1999 | Stevens | |
| 6,056,144 | A * | 5/2000 | Strange et al. | 220/297 |
| 6,612,456 | B1 | 9/2003 | Hundley et al. | |
| 6,688,487 | B2 | 2/2004 | Oakes et al. | |
| 6,932,234 | B2 | 8/2005 | D'Amato et al. | |
| 2002/0020709 | A1 * | 2/2002 | Huang et al. | 220/675 |
| 2004/0011803 | A1 * | 1/2004 | D'Amato | 220/780 |
| 2004/0159080 | A1 | 8/2004 | Stewart et al. | |

FOREIGN PATENT DOCUMENTS

| | | | |
|---|---|---|---|
| EP | 1 367 001 | A1 | 12/2003 |
| FR | 1379233 | | 11/1964 |
| FR | 1526655 | | 5/1968 |
| JP | 52-76459 | | 11/1950 |
| JP | 2004-1892 | | 1/2004 |
| JP | 2004-98663 | | 4/2004 |
| WO | WO-0230783 | | 4/2002 |

* cited by examiner

LID FOR A CUP-SHAPED RECEPTACLE

The present invention is related to a lid according to the preamble of claim 1.

Such a lid is known, for example, from EP 1 367 001 A1. These lids are designed to be clipped or clamped onto a cup-shaped receptacle, in order to close the receptacle and to enable transporting of the receptacle without the risk of the fluid contained in the receptacle spilling over the rim. Such a lid has to comply with a number of sometimes contradicting requirements. For example, being a disposable product, manufacturing costs are preferably as low as possible. In order to reduce costs for transport and storage, the lids should be stackable without jamming. Handling of the lids should be as easy as possible. In particular, the lids should be easily detachable from a stack, and they should be able to be easily clipped onto the corresponding receptacle. A prominent requirement of the lids is their fluid tightness. Not only during transport of the receptacles, but also in the event of a receptacle falling down and undergoing a slight deformation at the impact on the ground, the lid should rest tightly clipped onto the receptacle and prevent fluid from leaking out. When the receptacle is tilted, the lid should prevent a leakage of fluid for at least 15 seconds, preferably even longer.

The object of the present invention is to provide a lid which is improved over the conventional lid with respect to one or several of the above listed requirements.

This object is solved by a lid with the features of claim 1. Advantageous embodiments are listed in the dependent claims.

In the inventive lid, the projecting tip defines a horizontal plane. This definition of a horizontal plane can be achieved in different ways, depending on the shape of the projection. If the projecting tip extends on a circular line or on a section thereof, in a circumferential direction of the lid, the horizontal plane can be defined by three different points on this circular line. If a projection is provided on different sections of the clamping groove, the horizontal plane may again be defined by the common plane of different sections of the projecting tip.

According to the present invention, an angle between this horizontal plane and a tangential plane to the end of the upper wall of the projection adjacent the projecting tip is smaller than an angle between the horizontal plane and a tangential plane to the end of the lower wall of the projection adjacent the projecting tip. This feature has the following advantageous effect: when the beaded rim of the receptacle is inserted into the clamping groove, it eventually contacts the lower wall of the projection. This lower wall serves as a kind of ramp when the beaded rim is further inserted into the clamping groove, such that the beaded rim of the receptacle pushes the flexible outer wall of the clamping groove outwards. When the beaded rim has passed the projection, the outer wall of the clamping groove snaps back, such that the projection partially closes the beaded rim within the groove. In the event of forces now acting on the lid to detach the same from the receptacle, the beaded rim contacts the upper wall of the projection. However, this upper wall encloses a smaller angle with the horizontal plane than the lower wall. Thus, the ability of the projection to act as a ramp is reduced in the backward direction. Instead of allowing the lid to be detached from the receptacle, the projection firmly holds the beaded rim within the clamping groove. In other words, the angle between the horizontal plane and the tangential plane to the end of the upper wall adjacent the projecting tip being smaller than an angle between the horizontal plane and a tangential plane to the end of the lower wall adjacent the projecting tip leads to a facilitated attachment of the lid onto the receptacle, while more strongly preventing a detachment of the lid from the receptacle. Thus, the invention at the same time facilitates handling of the lid and makes the lid tamper proof.

In order to achieve these functions, i.e. in order to facilitate clipping of the lid onto the receptacle while consecutively preventing a similarly easy detachment, the angle between the horizontal plane and a tangential plane to the end of the upper wall adjacent the projecting tip may advantageously be 10° to 35° smaller than the angle between the horizontal plane and a tangential plane to the end of the lower wall adjacent the projecting tip.

In a preferred embodiment of the present invention, the angle between the horizontal plane and a tangential plane to the end of the upper wall adjacent the projecting tip may have a value of 0° to 20°. Similarly, the angle between the horizontal plane and a tangential plane to the end of the lower wall adjacent the projecting tip may have a value of 20° to 45°.

The upper wall of the projection may have a variety of different shapes. For example, it could be planar. Advantageously, however, the upper wall extends with a non-zero curvature when viewed in a vertical cross-section of the lid. In particular, the upper wall may be formed concave towards the interior of the clamping groove. If shaped in this way, the projection is able to more securely hold the beaded rim of the receptacle in its clamped position within the clamping groove. In the event of forces acting on the lid to detach same from the receptacle, the beaded rim moves in an outward direction within the clamping groove. After a certain distance, the beaded rim contacts the upper wall of the projection. Due to the curvature of the upper wall, this upper wall now redirects the movement of the beaded rim towards the inner wall of the clamping groove. Thus, further outward movement of the beaded rim is attenuated or stopped, thus making a detachment of the lid from the receptacle more difficult.

The lower wall, on the other hand, may be substantially planar, or it may at least have a straight cross-section in a vertical section of the lid. With such a shape, movement of the beaded rim past the projection is facilitated, since during insertion of the beaded rim into the clamping groove, contact between the rim and the lower wall of the projection leads to the outer wall of the clamping groove bending outwards and thereby giving way for the beaded rim.

According to the present invention, another further improvement may be achieved if the depth of the clamping groove from its top until the projecting tip is larger than the corresponding height of the beaded rim of the cup-shaped receptacle. Thus, in the clamped position of the rim in the clamping groove, a clearance remains between the projecting tip and the rim. When the rim is inserted into the clamping groove and has moved past the projecting tip, the outer wall of the clamping groove, which has previously been bent outwards, suddenly snaps in behind the beaded rim. Due to the existence of a clearance between the projecting tip and the beaded rim, the outer wall may move further than its final rest position during this snap-back movement, until it contacts the beaded rim, before finally moving back to its rest position. The impact of the projection on the beaded rim, however, generates a clicking noise. The snap movement of the outer groove wall and the clicking noise are tactile and audible indicators to the user who is attaching the lid to the receptacle. Both indicators indicate that the lid is securely clamped onto the beaded rim of the receptacle. Since he can trust these indicators, the user does not have to check a tight fit of the lid on the receptacle, such that he can move on to handling the consecutive lid and receptacle. In conclusion, handling of the lid and receptacle is further facilitated. In addition, the clearance helps to keep the rim within the groove, even if either of them is slightly deformed, for example due to an impact of the receptacle on the ground.

Preferably, the distance between the projecting tip and the inner groove wall is equal to or less than two-thirds of the clamping groove at its broadest portion above the projecting tip, i.e. towards the inner end of the clamping groove. This size of the clamping groove leads to a secure fit of the lid on the receptacle, since the width of the clamping groove at its broadest portion above the projecting tip will correspond substantially to the width of the beaded rim.

On the other hand, the distance between the projecting tip and the inner groove wall may be equal to or more than half the width of the clamping groove at its broadest portion above the projecting tip. Such a size of the clamping groove allows the beaded rim to easily pass the projecting tip, when the lid is attached onto the receptacle.

In an embodiment of the present invention, the height of the inner groove wall between the top of the clamping groove and the central lid portion is at least as large as the depth of the clamping groove from its top until the projecting tip. In other words, the inner groove wall extends at least until the projecting tip, preferably below the projecting tip. This feature allows a sufficiently large portion of the inner wall to constantly contact the wall of the receptacle, in order to form a fluid tight seal between the lid and the receptacle. This contact between the lid and the receptacle may occur on a circumferential line. However, fluid tightness is significantly enhanced if the contact occurs not only on a line, but on a planar or curved two-dimensional contact area.

In order for the lid to be specially fluid tight, it may be contemplated to form the height of the inner groove wall at least as large as the height of the outer groove wall. If the height of the inner groove wall is made even larger than the height of the outer groove wall, the inner groove wall may have an additional advantage by serving as a kind of guiding surface when the lid is placed onto the receptacle. By interfering with the inner wall of the receptacle, the inner groove wall helps to guide the lid on the receptacle in order to bring the lid to its clamping position.

The constrictions may be provided at intervals on the outer groove wall of the lid. If they are provided at equidistant intervals on the outer groove wall, the clamping force may be distributed evenly on the circumference of the lid.

It is also possible to provide the constriction on the full circumference of the lid, thereby yielding a strong clamping force on the complete circumference of the lid.

In an advantageous embodiment of the present invention, the lid is made from plastic material. In particular, the material of the lid can be a mixture of at least a first plastic material and a second plastic material, wherein the first material has a higher stiffness than the second material. Such a mixture allows to obtain a sufficiently stiff lid, while at the same time offering a high enough flexibility for the outer groove wall to bend outwards and snap in behind the beaded rim in order to securely hold the rim in the clamping groove. Also, a slight deformation of the clamping groove walls allows to exert sufficient clamping pressure onto the beaded rim of the receptacle.

In order to reduce manufacturing costs, it is advantageous if the first and the second plastic materials are of the same type. For example, the materials can both be polystyrene materials.

The first plastic material is preferably General Purpose Polystyrene (GPPS). This material is not only easy to handle, but it offers sufficient stability for the lid. Moreover, it is highly transparent.

For the second plastic material, on the other hand, High Impact Polystyrene (HIPS) may be chosen. This material offers a high durability under impact. When the closed receptacle with the lid falls down, HIPS may prevent the lid from breaking.

Tests have shown that it is advantageous if the first material participates in the mixture with a percentage of 30 to 50%, while the second material participates in the mixture with a percentage of 50 to 70%. In particular, the first material may have a percentage of about 40%, while the second material may have a percentage of approximately 60%. Such a mixture offers convincing results with respect to stiffness and durability. If the mixture is made from GPPS and HIPS, the exact content of the mixture does not only determine its stiffness, but also its transparency. While GPPS is highly transparent, HIPS is opaque. A certain degree of transparency may be preferred in order to enable the user to determine whether the receptacle is filled and what color the filling has.

A preferred way of manufacturing the lid is to form same by deep drawing and/or thermoforming from a sheet or foil. Such a method of manufacturing is rather inexpensive.

Again, tests have shown that a sufficient stability or stiffness of the lid may be achieved when deep drawing same from a sheet or foil which has an initial thickness, i.e. before deep drawing, of 0.24 to 0.36 mm, preferably 0.27 to 0.33 mm. Depending on the height of the different portions of the lid, the average thickness of the lid may then be 0.17 to 0.23 mm. This thickness results in a sufficient stability, while at the same time avoiding using more material than necessary, hence reducing manufacturing costs.

Often, the receptacles will be formed with conical walls. In these cases, it is advantageous if the inner groove wall of the lid is also conical. In particular, the half cone angle of the inner groove wall of the lid may have a value of 3.5° to 7°, depending on the conicity of the receptacle for which the lid is to be used.

On the other hand, it is not necessary that the conicity of the inner groove wall corresponds exactly to the conicity of the receptacle wall. A deviation of up to +/−2° to 3° in the respective half cone angles is tolerable with respect to fluid tightness and may be advantageous in order to enable the lid to be used for different receptacles with differing conicities of their side walls. This may again help to reduce manufacturing costs.

Another advantage may be achieved if, in the position of the lid clamped onto the receptacle, the spacing between the inner groove walls across the central lid portion at a certain height position is 1% to 8% smaller than the spacing between the receptacle walls at the same height position at the horizontal plane H or in the adjacent regions above or below the plane H, preferably 2%to 5%. This dimensional difference will ensure the generation of a sufficiently high clamping force exerted from the inner groove walls onto the receptacle walls, forcing the beaded rim into the clamping groove and also providing a certain degree of friction between the inner groove wall and the receptacle wall which will further prevent a detachment of the lid from the receptacle.

The invention is also directed to a combination of a receptacle and a corresponding lid.

Figure 2:
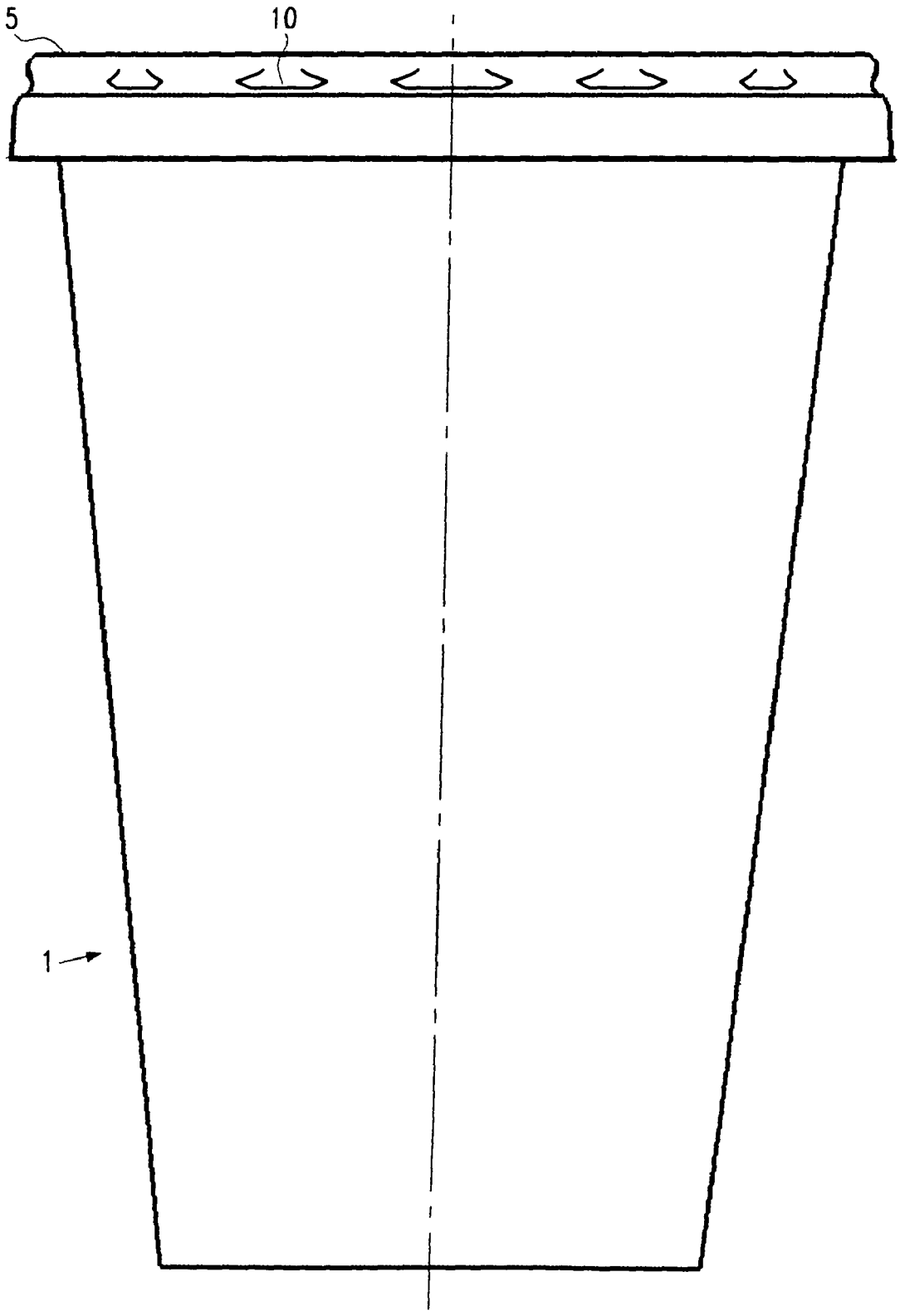
Figure 3:
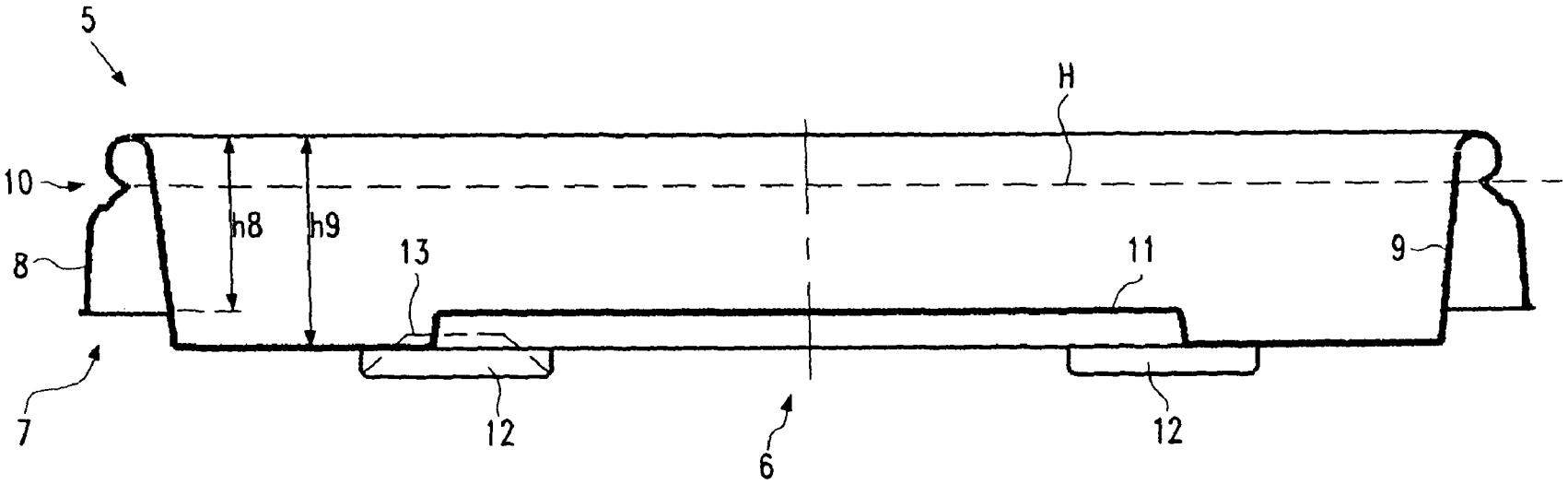
Figure 4:
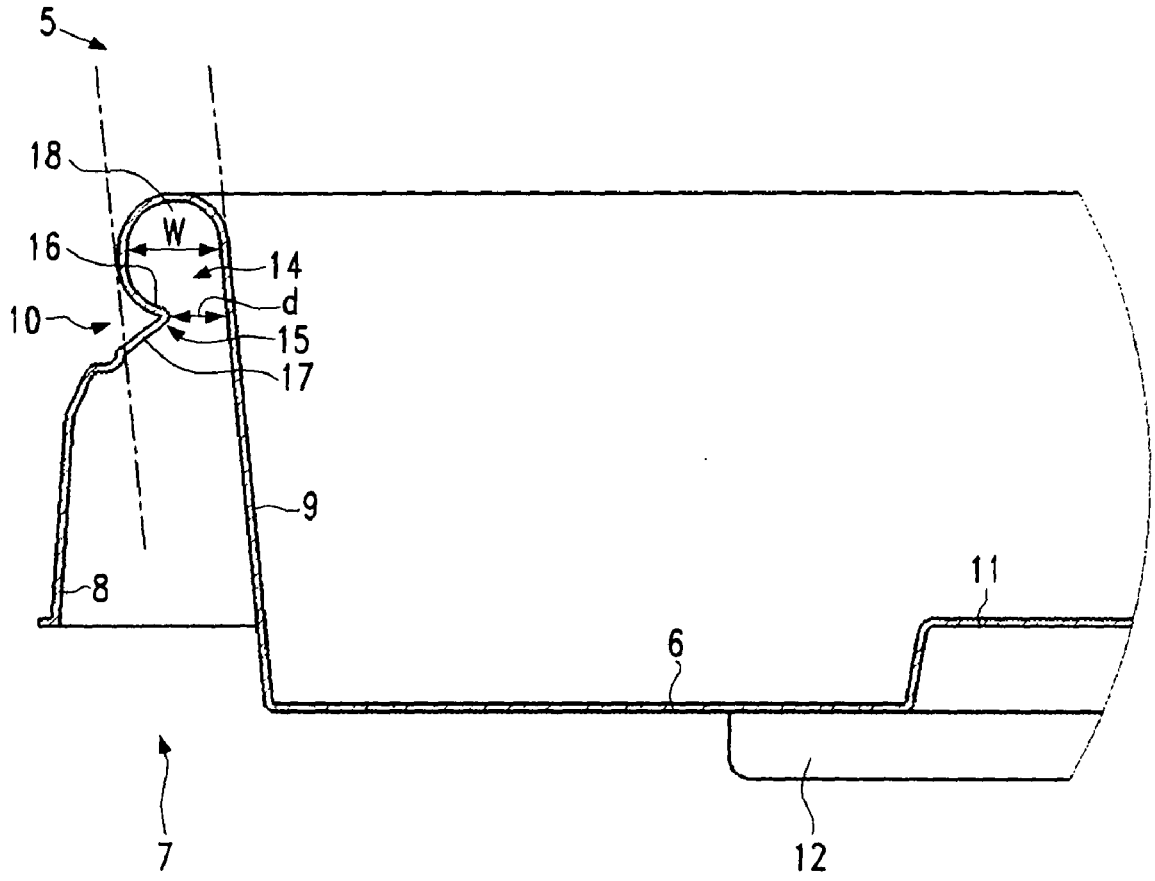
Figure 5:
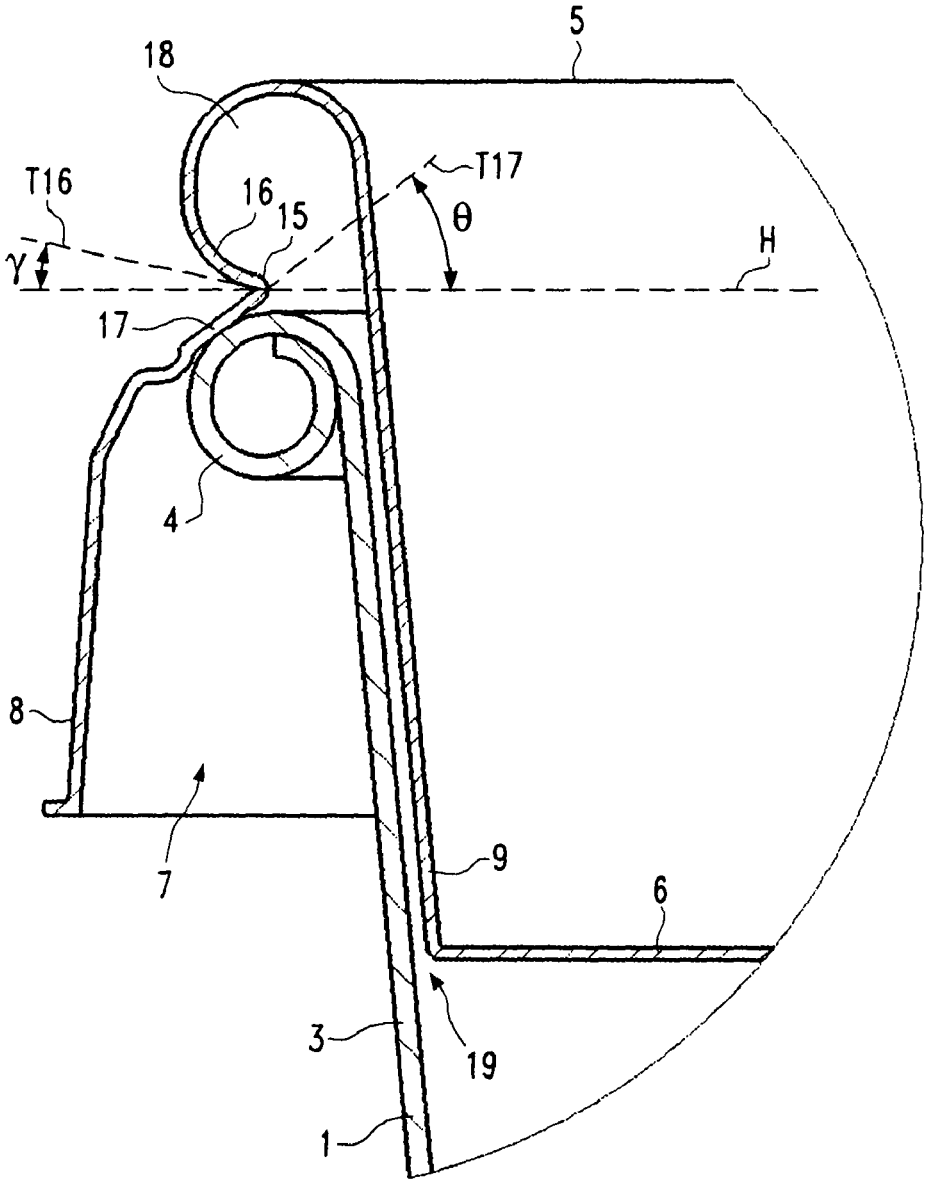
Figure 6:
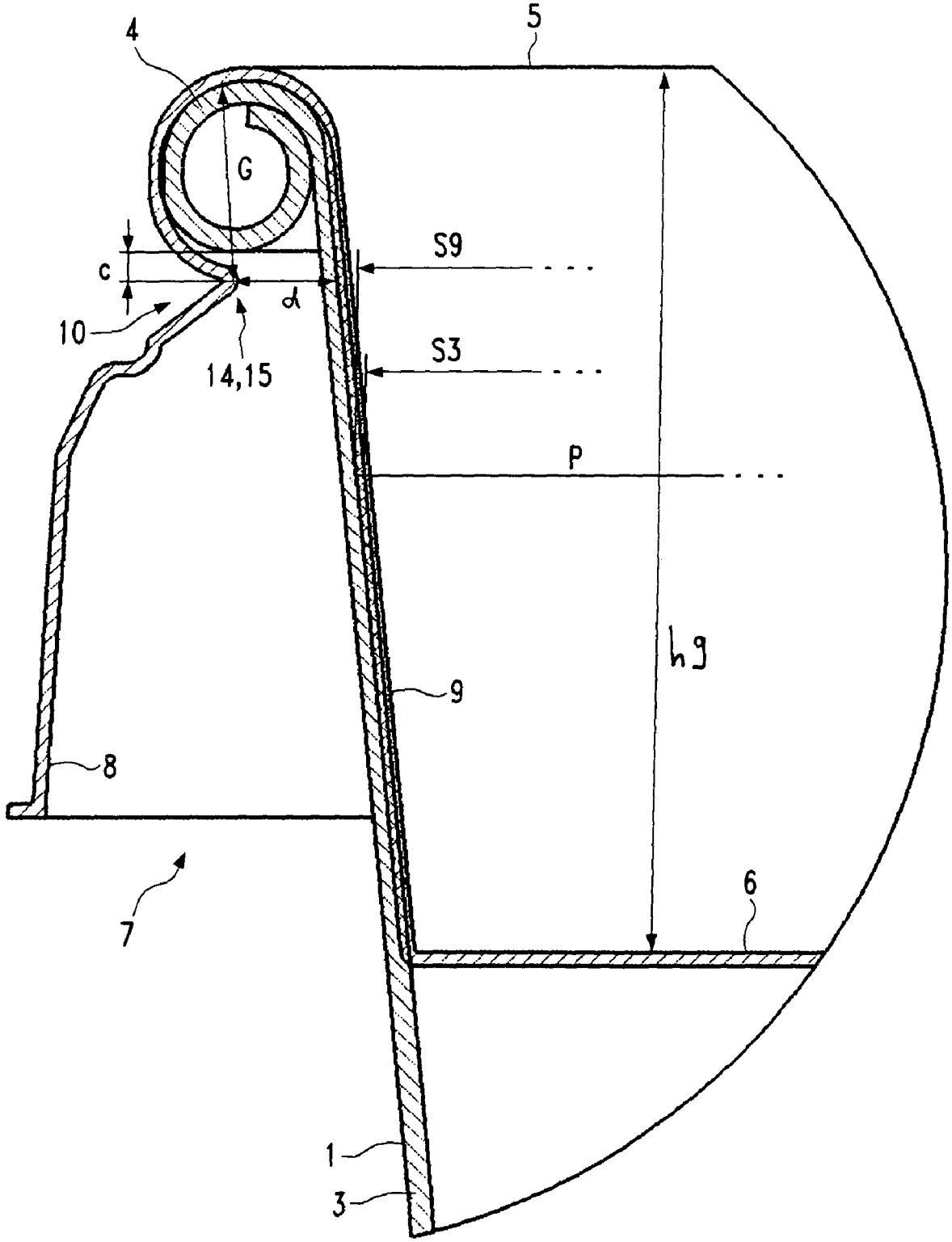
Figure 7:
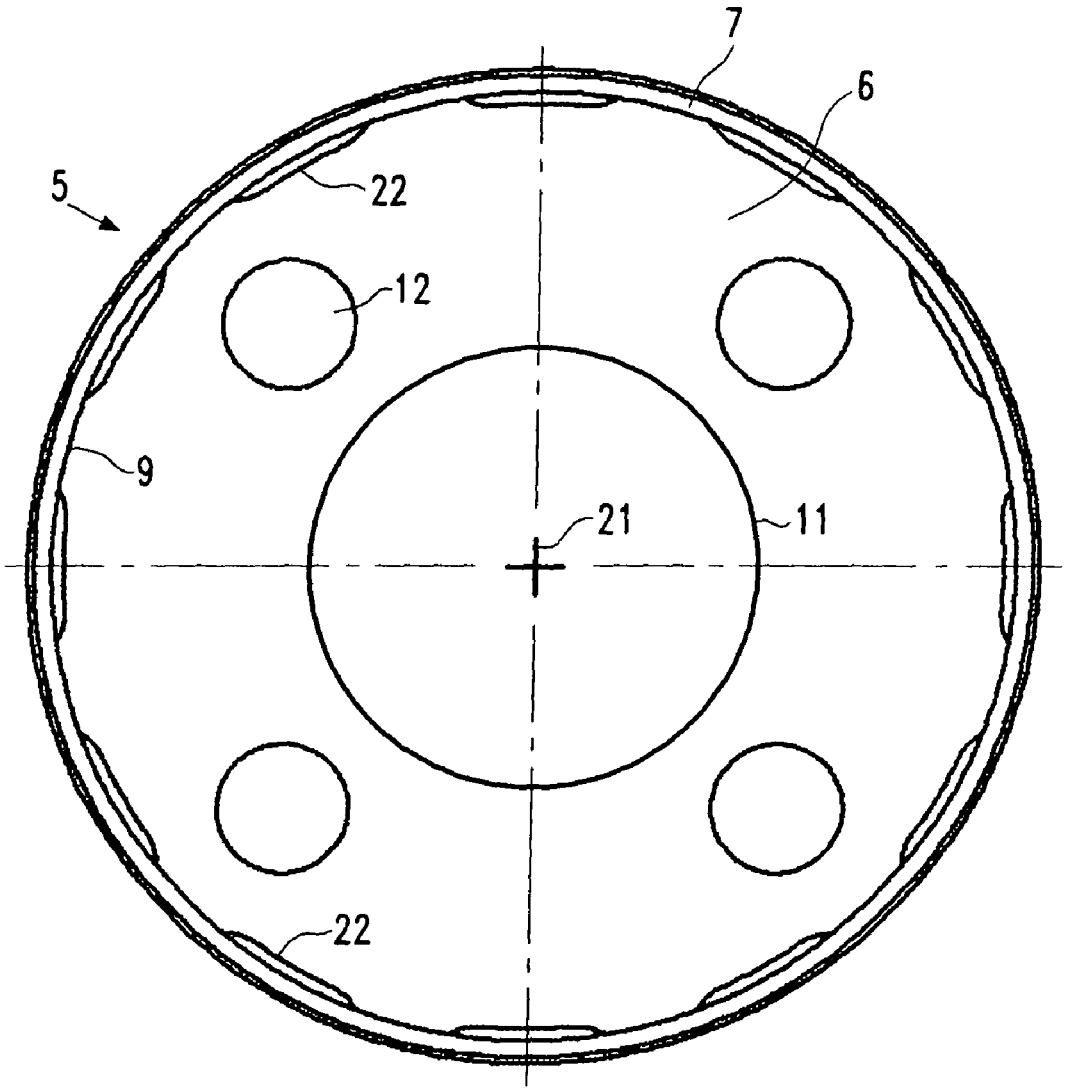
Figure 8:
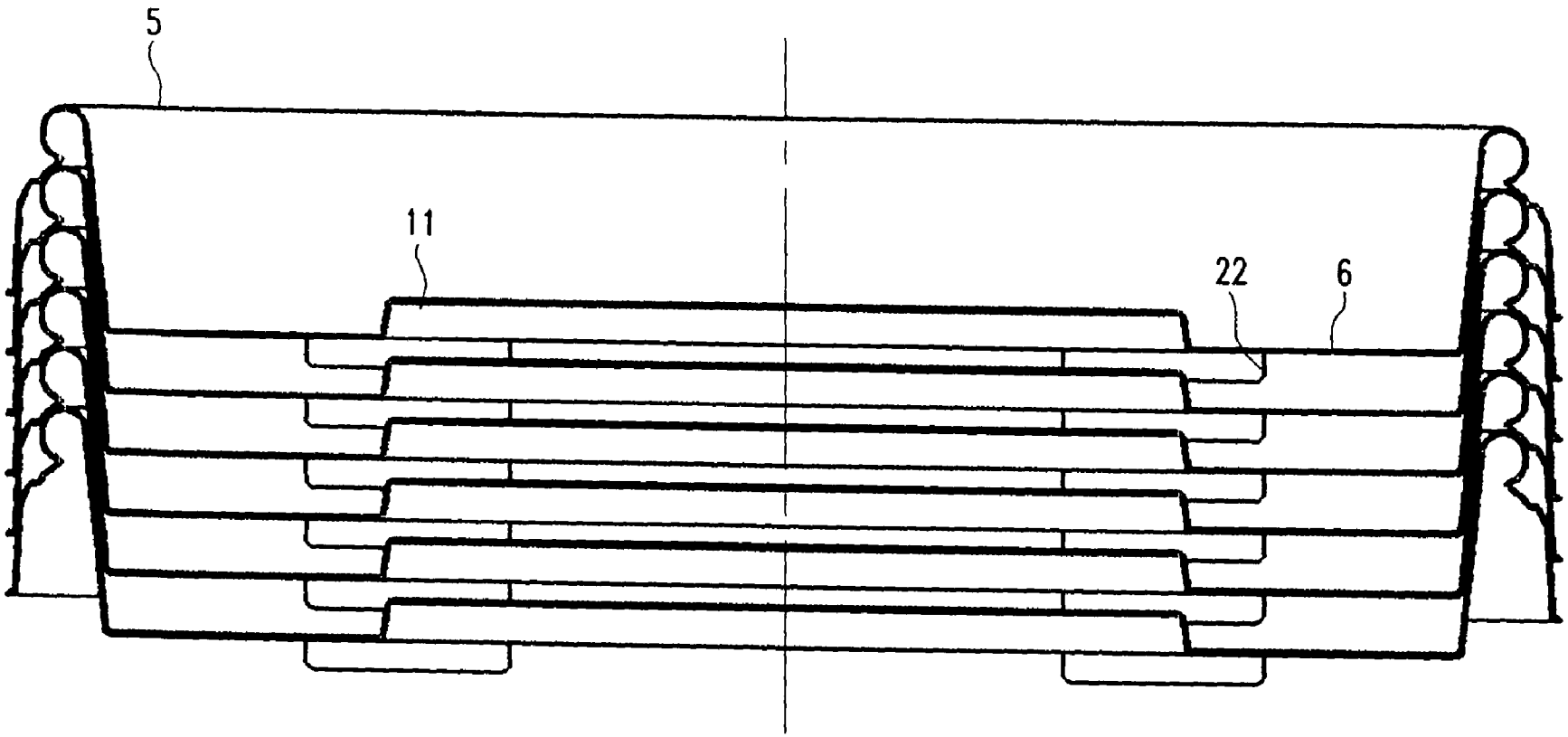

In the following, a preferred embodiment of the present invention will be described with respect to the accompanying drawings. In these drawings, FIG. 1 shows a front view of a cup-like receptacle and a lid according to an embodiment of the present invention, FIG. 2 shows the receptacle and the lid of FIG. 1 in their clamped position, FIG. 3 shows a vertical section of the lid, FIG. 4 shows a detail of the cross-section shown in FIG. 3, FIG. 5 shows the rim of the receptacle during insertion into the clamping groove of the lid, FIG. 6 shows the lid clamped onto the rim of the receptacle, FIG. 7 shows a top view of the lid, and FIG. 8 shows a vertical cross-section of six stacked lids.

The same components will be referred to by the same reference numerals throughout the drawings.

FIG. 1 shows a front view of a cup-like receptacle 1. The receptacle 1 comprises a receptacle bottom 2 and side walls 3. Opposite the receptacle bottom 2, the side walls 3 end in a beaded or curled rim 4. The side walls 3 of the receptacle 1 may comprise more than one layer, making the receptacle 1 a single, double or multi-wall receptacle. They may also be provided with de-nesting means (not shown) for facilitating stacking of the receptacles 1.

Shown separated from the receptacle 1, there is a lid 5. This lid 5 comprises a central lid portion 6 for covering the opening of the receptacle 1. On the periphery of the lid, circumscribing the central lid portion 6, the lid is provided with a clamping groove 7 which may, as shown later, be clamped onto the beaded rim 4 of the receptacle 1. For this purpose, the extension of the clamping groove 7 corresponds to the extension of the rim 4. For example, both the clamping groove 7 and the rim 4 may have a circular extension in a horizontal plane.

The peripheral clamping groove 7 of the lid 5 is formed between an outer groove wall 8 and an inner groove wall 9. The outer groove wall 8 is provided with a series of equidistantly spaced constrictions 10. These constrictions 10 are formed as depressions on the outside of the outer wall 8, thereby forming a corresponding projection into the interior of the clamping groove 7, as explained later in more detail. Due to the clamping groove 7 being narrowed by the constriction 10, the lid 5 may be snapped, clicked or clamped onto the beaded rim 4 of the receptacle 1, which will also be discussed later.

The inner groove wall 9, which connects the outer groove wall 8 with the central lid portion 6, extends over a greater height than the outer groove wall 8. Due to this shape, the central lid portion 6 projects over the lower end of the outer groove wall 8 on the bottom side of the lid 5. Due to the inner groove wall 9 being conical, the lateral dimension of the central lid portion 6 is smaller than the lateral dimension of the opening of the receptacle 1. Thus, when the lid 5 is placed onto the receptacle 1, the central lid portion 6 can more easily be placed in the opening of the receptacle 1, and the inner groove wall 9 then serves as a guide surface for guiding the lid 5 into its clamped position on the receptacle 1 (as shown in FIG. 2).

As shown in FIG. 1, the diameter D of the clamping groove 7 is approximately equal to the diameter D of the rim 4 across the opening of the receptacle 1. Further, the conicity of the inner groove wall 9 is substantially equal to a conicity of the side walls 3 of the receptacle 1. Both the half cone angle $\alpha$ of the inner groove wall 9 and the half cone angle $\beta$ of the side wall 3 of the receptacle may have values between 3.5° and 7°. The smaller the difference between the half cone angle $\alpha$ of the inner groove wall 9 and the half cone angle $\beta$ of the side wall 3, the better is the fluid tightness of the lid 5 when clamped onto the receptacle 1. On the other hand, it may be advantageous to form receptacles 1 with different volumes by giving these receptacles 1 a different half cone angle $\beta$ of their side walls 3, while maintaining the same diameter D across the opening of the receptacle. This will allow a lid 5 with certain dimensions to be placed onto receptacles 1 with different volumes. Due to this, the number of different sizes of lids 5 can be reduced, thereby also reducing manufacturing costs. In order to nevertheless be able to provide a sufficiently tight sealing of the receptacles 1 of different volume, it is then advantageous to form the inner groove wall 9 of the multipurpose lid 5 with a half cone angle $\alpha$ which has a value between the different half cone angles $\beta_1$, $\beta_2$, of the receptacles 1 of different volume. For example, if a medium sized receptacle has a half cone angle $\beta_1$ of 3° at its side walls, and the side walls 3 of a large size receptacle 1 have a half cone angle $\beta_2$ of 4.3°, the half cone angle $\alpha$ of the inner groove wall 9 of a lid designed to be used for both types of receptacles 1 may have a value between 5° and 5.3°.

FIG. 2 shows the lid 5 in its clamped position on the receptacle 1. In this position, the constrictions 10 have snapped in on the underside of the beaded rim 4 of the receptacle 1, such that the beaded rim 4 is now securely located at the top of the clamping groove 7.

FIG. 3 shows a vertical section of the lid 5 shown in the previous drawings. As already explained, the inner groove wall 9 extends over a greater height h9 than the height h8 of the outer groove wall 8, such that the inner groove wall 9 may serve as a guiding surface when the lid 5 is placed onto the receptacle 1. In the embodiment shown in FIG. 3, the center of the central lid portion 6 is raised, thereby forming a dome 11. The dome 11 increases the stability of the lid 5. At or near its center, the top wall of the dome may be provided with an incision into the material or a complete cut through the material. This cut, which is shown with a cross-like shape in FIG. 7, weakens the material and allows the user to penetrate the lid 5 with a straw when the lid 5 is placed onto the receptacle 1.

Two stabilizing depressions 12 project over the underside of the central lid portion 6. They stabilize the central lid portion 6 by being irregularities in an otherwise flat central lid portion 6. In addition, when the lid 5 is placed onto a table or another flat surface, the depressions 12 help to raise the other parts of the lid 5 over the flat surface, thereby making it easier for a user to grab the lid 5 under the outer groove wall 8. A further effect may be achieved with the stabilizing depressions 12, if a depression 12 is provided with its own indicator dome 13. The user may use this indicator dome 13 as a push button. After being pushed onto the underside of the stabilizing depression 12, the indicator dome 13 has not only changed its shape, but also its color or transparency, thereby being able to serve as an indicator means for indicating to the user the type of liquid contained in the receptacle 1.

FIG. 4 shows an enlarged view of the left side of the lid 5 already shown in FIG. 3. As shown here, the constriction 10 is formed by pushing the material of the outer groove wall into the interior of the clamping groove 7. Thus, the constriction 10 forms a projection 14 which projects into the interior of the groove 7. This projection 14 comprises a projecting tip 15, at which tip 15 the projection projects furthest into the clamping groove 7. The projecting tip 15 separates an upper wall 16 and a lower wall 17 of the projection 14. Above the projecting tip 15, i.e. towards the top 18 of the clamping groove 7, the clamping groove 7 becomes broader again and has a width W between the outer groove wall 8 and the inner groove wall 7 at its broadest portion above the projection 14. At this point, the clamping groove 7 may receive the beaded rim 4 of the receptacle 1 in the clamped position. Compared to this width W, the clamping groove 7 is narrowed by the projection 14. In particular, the distance d between the projecting tip 15 and the opposing inner groove wall 8 is preferably equal to or more than half the width W of the clamping groove 7 at its broadest portion about the projection 14, and equal to or less than ⅔ of the width W. With these dimension, the clamping groove 7 is broad enough to let the beaded rim 4 pass, when the lid 5 is attached onto the receptacle 1 and narrow enough to hold the rim 4 securely in the clamped position.

The clamping groove 7 of the lid 5 is shown even larger in another sectional view in FIG. 5. In particular, FIG. 5 shows the situation of the lid 5 being pushed onto the receptacle 1 so far, that the beaded rim 4 of the receptacle 1 is already inserted into the clamping groove 7 and contacts the lower wall 17 of the projection 14. In this sectional view, the lower wall 17 has a straight cross-section, while the upper wall 16 of the projection 14 has a curved cross-section. As shown in FIG. 3, the projecting tips 15 of the constrictions 10 of the lid 5 define a horizontal plane H. This is the common plane H on which all projecting tips 15 around the periphery of the lid 5 are located. This horizontal plane H is shown again in FIG. 5. In addition, FIG. 5 shows the extension of a tangential plane T16 which is tangential to the end of the upper wall 16 adjacent the projecting tip 15, as well as the extension of a plane T17, which is tangential to the end of the lower wall 17 adjacent the projecting tip 15. It can now be appreciated that, according to the present invention, an angle γ between the horizontal plane H and the tangential plane T16 to the end of the upper wall 16 adjacent the projecting tip 15 is smaller than an angle θ between the horizontal plane H and the tangential plane T17 to the end of the lower wall 17 adjacent the projecting tip 15.

As already explained earlier, the difference of these angles γ, θ has the following effect: when the beaded rim 4 of the receptacle 1 is pushed into the clamping groove 7, as shown in FIG. 5, it contacts the lower wall 17 of the projection 14. This lower wall 17 now acts as a ramp, guiding the beaded rim 4 to the open portion of the clamping groove 7 and, at the same time, causing the flexible outer groove wall 8 to expand in an outward direction, thereby increasing the open width of the clamping groove 7. When the distance d between the projecting tip 15 and the opposing, inner groove wall 9 has become large enough for the beaded rim 4 to pass, the beaded rim 4 of the receptacle 1 passes the projection 14 and enters into the top portion 18 of the clamping groove 7. The clamped position of the lid 5 on the receptacle 1 is shown in FIG. 6. Returning now to FIG. 5, the angle θ between the lower wall 17 and the horizontal plane H of the lid 5 has a value of 38°. This angle θ, which may be in the range between 20° and 50° or even larger, allows the lower wall 17 to fulfill its ramp function advantageously. The angle γ between the tangential plane to the upper wall 16 of the projection 14 and the horizontal plane H, on the other hand, has a value of about 16°. Due to this rather small angle, the lower wall is not able to act as a ramp, when the beaded rim 4 of the receptacle 1 is located in the clamped position (c.f. FIG. 6) and is subject to forces which try to disengage the beaded rim 4 from the clamping groove 7. Instead of acting as a ramp by bending the outer groove wall 8 outwards, the upper wall 16 of the projection 14 then rather acts as a kind of block, securely holding the beaded rim 4 of the receptacle 1 in the clamped position within the clamping groove 7.

In the position of the lid 5 on the receptacle 1 shown in FIG. 5, there is still an air gap 19 between the receptacle wall 3 and the inner groove wall 9. This air gap 19 serves to vent the receptacle 1, while the lid 5 is being pushed onto the receptacle 1, thereby preventing the generation of an overpressure underneath the lid 5.

In the clamped position of the lid 5 on the receptacle 1, as shown in FIG. 6, there is no air gap 19 anymore between the receptacle wall 3 and the inner groove wall 9. Instead, due to having similar half cone angles α, β (c.f. FIG. 1), the inner receptacle wall 3 and the inner groove wall 9 are in tight, two-dimensional contact, thereby creating a strong sealing between the lid 5 and the receptacle 1. As shown here, the height h9 of the inner groove wall 9 is larger than the depth G of the clamping groove 7 from its top 18 until the projecting tip 15. In other words, the inner groove wall 9 extends below the projecting tip 15. This leads to the receptacle wall 3 and the inner groove wall 9 contacting each other on a comparatively large contact area, thereby enhancing the sealing effect. Of course, the height h9 of the inner groove wall 9 may also be smaller than shown in FIG. 6, as long as the height h9 is at least as large as the depth G of the clamping groove 7.

As also indicated in FIG. 6, in this clamped position, a spacing S9 between the outside of the inner groove walls 9 (i.e. facing towards the clamping groove 7) across the central lid portion 6 at a certain height position P is about 1% to 8% larger than a spacing S3 between the inner side of the receptacle walls 3 at the same height position P, preferably 2% to 5% larger. Due to this size difference, the inner groove wall 9 may exert an outward pressure onto the receptacle walls 3, thereby more strongly holding the beaded rim 4 of the receptacle 1 within the clamping groove 7. In particular, as shown in FIG. 6, the beaded rim 4 contacts the outer groove wall 8 merely in an outer portion, and in a top portion. In order to form a tight fit between the clamping groove 7 and the beaded room 4, the shape of the top wall 20 of the clamping groove 7 is adapted to the shape of the beaded rim 4.

In the clamped portion, a clearance C remains between the beaded rim 4 and the projecting tip 15, since the depth G of the clamping groove 7 above the projecting tip is larger than the corresponding height of the beaded rim 4. Due to the existence of this clearance C, the outer groove wall 8 may hit the beaded rim 4 when the outer groove wall 8 snaps back behind the rim 4. This rapid contact between the projection 14 and the beaded rim 4 leads to the generation of a noise, as well as to the generation of a tactile feeling for the user. Both the tactile feeling and the clicking noise are indicators to the user that the lid 5 has reached its clamped position.

FIG. 7 shows a top view of the lid 5. Four depressions 12 are located on the central portion 6 of the lid 5, as well as the central dome 11. In the center of this central dome 11 there is a cross-like incision or cut 21 for facilitating penetration of the lid 5 with a straw. In this top view, the constrictions 10 are not visible. They can be located at equidistant or non-equidistant intervals on the periphery of the lid 5. It is also possible that a single constriction 10 extends on the complete circumference of the lid 5.

On the periphery of the central lid portion 6, the inner groove wall 9 is provided with a number of de-nesting steps 22. Here, the de-nesting steps 22 are located at equidistant intervals.

The effect of the de-nesting steps 22 is shown in FIG. 8: when the lids 5 are stacked, an upper lid 5 rests with its central lid portion 6 on the de-nesting steps 22 of the adjacent, lower lid 5. An air gap is thereby maintained between the central lid portions 6 of two adjacent lids 5, thereby preventing the generation of an underpressure when a user attempts to separate the two lids 5 from each other. In this way, the de-nesting steps 22 facilitate handling of the lids 5 by facilitating the separation of the stacked lids 5.

The lid is preferably formed by deep drawing from a sheet or foil of plastic material. In an advantageous embodiment, the plastic material is a mixture of General Purpose Polystyrene (GPPS), which offers a high stiffness and transparency, and High Impact Polystyrene (HIPS), which offers a high breaking resistance. The sheet or foil, from which the lid 5 is deep drawn, may have an initial thickness before the deep drawing process of approximately 0.3 mm. After deep drawing, the average thickness of the lid may have a value between 0.17 and 0.23 mm.

Starting from the preferred embodiment of the lid 5 shown in the drawings, the lid 5 may be amended in several ways. For example, the lid 5 does not need to have a central dome 11 or stabilizing depressions 12, all these elements could also be shaped with different heights with respect to the central lid portion 6. The lid does not need to be made from a plastic material, although this is preferred with respect to a reduction of manufacturing costs. The values of the dimensions or angles explained above, or the relations between several of these values may also be amended. Further, both the receptacle and the lid may have different cross-sections, such as square.

The invention claimed is:

1. A lid comprising:

a central lid portion; and a peripheral clamping groove formed between an outer groove wall and an inner groove wall for being clamped onto a beaded rim of a cup-shaped receptacle, wherein a constriction is provided on at least a peripheral section of the outer groove wall, the constriction forming a projection into the interior of the groove, the projection comprising a projecting tip, an upper wall and a lower wall, the projecting tip defining a horizontal plane, wherein an angle (γ) between the horizontal plane and a tangential plane to the end of the upper wall adjacent the projecting tip is 10° to 35° smaller than the angle (θ) between the horizontal plane and a tangential plane to the end of the lower wall adjacent the projecting tip, and wherein the angle (γ) between the horizontal plane and the tangential plane to the end of the upper wall adjacent the projecting tip is 0° to 20°.

2. The lid according to claim 1, wherein the angle (θ) between the horizontal plane and a tangential plane to the end of the lower wall adjacent the projecting tip is 20° to 45°.

3. The lid according to claim 1, wherein the upper wall has a curved cross-section.

4. The lid according to claim 1, wherein the upper wall is concave towards the interior of the clamping groove.

5. The lid according to claim 1, wherein the lower wall has a straight cross-section.

6. The lid according to claim 1, wherein the depth of the clamping groove from its top until the projecting tip is larger than the corresponding height of the beaded rim of the cup-shaped receptacle.

7. The lid according to claim 6, wherein the distance between the projecting tip and the inner groove wall is equal to or less than two thirds of the width of the clamping groove at its broadest portion above the projection.

8. The lid according to claim 7, wherein the distance between the projecting tip and the inner groove wall is equal to or more than half the width of the clamping groove at its broadest portion above the projection.

9. The lid according to claim 8, wherein the height of the inner groove wall between the top of the clamping groove and the central lid portion is at least as large as the depth of the clamping groove from its top until the projecting tip.

10. The lid according to claim 9, wherein the height of the inner groove wall is as large as or larger than the height of the outer groove wall.

11. The lid according to claim 1, wherein constrictions are provided at equidistant intervals on the outer groove wall.

12. The lid according to claim 1, wherein the constriction is provided on the full circumference of the lid.

13. The lid according to claim 1, wherein the material of the lid is a mixture of at least a first plastic material and a second plastic material, the first material having a higher stiffness than the second material.

14. The lid according to claim 13, wherein the first and the second plastic material are both polystyrene materials.

15. The lid according to claim 14, wherein the first plastic material is General Purpose Polystyrene (GPPS).

16. The lid according to claim 15, wherein the second plastic material is High Impact Polystyrene (HIPS).

17. The lid according to claim 16, wherein the first material participates in the mixture with a percentage of 30-50%, while the second material participates in the mixture with a percentage of 50-70%.

18. The lid according to claim 1, wherein the lid was formed by deep drawing from and/or thermoforming of a sheet or foil.

19. The lid according to claim 18, wherein the sheet or foil has an initial thickness before deep drawing of 0.24-0.36 mm, preferably 0.27-0.33 mm.

20. The lid according to claim 1, wherein the average thickness of the lid is 0.17-0.23 mm.

21. The lid according to claim 1, wherein a half cone angle of the inner groove wall of the lid is between 3.5° and 7°.

22. The lid according to claim 21, wherein a conicity of the inner groove wall of the lid corresponds to +/−2° of a conicity of the receptacle wall.

23. The lid according to claim 1, wherein the position of the lid clamped onto the receptacle, the spacing between the outside of the inner groove walls across the central lid portion at a certain height position is 1 to 8% larger than the spacing between the inner side of the receptacle walls at the same height position at the horizontal plane defined by the projecting tip or in the adjacent regions above or below the plane, preferably 2% to 5% larger.

24. A combination of a receptacle and a lid according to claim 1.

25. A lid comprising:

a central lid portion; and a peripheral clamping groove formed between an outer groove wall and an inner groove wall for being clamped onto a beaded rim of a cup-shaped receptacle, and a constriction on at least a peripheral section of the outer groove wall, the constriction forming a projection into the interior of the groove, the projection comprising a projecting tip, an upper wall and a lower wall, the projecting tip defining a horizontal plane, wherein an angle γ between the horizontal plane and a tangential plane to the end of the upper wall adjacent the projecting tip is smaller than an angle (θ) between the horizontal plane and a tangential plane to the end of the lower wall adjacent the projecting tip, and wherein the angle (γ) between the horizontal plane and a tangential plane to the end of the upper wall adjacent the projecting tip is 0° to 20°.

* * * * *